US012352508B2

(12) United States Patent
Endo et al.

(10) Patent No.: US 12,352,508 B2
(45) Date of Patent: Jul. 8, 2025

(54) HEAT EXCHANGER AND METHOD FOR MANUFACTURING SAME

(71) Applicant: HONDA MOTOR CO., LTD., Tokyo (JP)

(72) Inventors: Tsuneo Endo, Saitama (JP); Yuta Kurosawa, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 250 days.

(21) Appl. No.: 18/128,696

(22) Filed: Mar. 30, 2023

(65) Prior Publication Data

US 2023/0314083 A1 Oct. 5, 2023

(30) Foreign Application Priority Data

Mar. 31, 2022 (JP) ..... 2022-060284
Oct. 28, 2022 (JP) ..... 2022-173687

(51) Int. Cl.
*F28D 7/10* (2006.01)
*F28F 1/10* (2006.01)

(52) U.S. Cl.
CPC . *F28D 7/10* (2013.01); *F28F 1/10* (2013.01)

(58) Field of Classification Search
CPC ..... F28D 1/10; F28D 7/10
USPC ..... 165/157
See application file for complete search history.

(56) References Cited

U.S. PATENT DOCUMENTS 5,410,574 A * 4/1995 Masumoto ..... G21B 1/13 376/150

FOREIGN PATENT DOCUMENTS

JP 2011-252192 A 12/2011
JP 2017-150756 A 8/2017
KR 20010098882 A * 11/2001

* cited by examiner

*Primary Examiner* — Davis D Hwu
(74) *Attorney, Agent, or Firm* — Paratus Law Group, PLLC

(57) ABSTRACT

A heat exchanger includes a partition wall that separates two fluids having different temperatures. A plurality of grooves having a depth of 100 μm to 400 μm are formed in a thickness direction of the partition wall on a first wall surface of the partition wall which is a surface on a side in contact with a fluid of the two fluids that has a lower heat transfer coefficient.

9 Claims, 7 Drawing Sheets

HEAT EXCHANGER AND METHOD FOR MANUFACTURING SAME

CROSS-REFERENCE TO RELATED APPLICATIONS

This application is based upon and claims the benefit of priority from Japanese Patent Application No. 2022-060284, filed Mar. 31, 2022, and Japanese Patent Application No. 2022-173687, filed Oct. 28, 2022, the entire contents of which are incorporated herein by reference.

TECHNICAL FIELD

The present disclosure relates to a heat exchanger including a partition wall that separates two fluids having different temperatures, and a method for manufacturing the same.

BACKGROUND ART

In the related art, heat exchangers using various heat transfer methods are widely used as the devices for transferring heat between two fluids having different temperatures. In a surface type (partition wall type) heat exchanger, two fluids flow in two spaces partitioned by the partition wall, respectively, and heat is exchanged between the two fluids by the heat transfer via the partition wall or the like.

In recent years, in order to allow more people to secure access to affordable, reliable, sustainable and advanced energy, many researches and developments are actively conducted to contribute to the energy efficiency. In order to contribute to the energy efficiency, there is a need for the improvement in the heat exchange efficiency for the heat exchangers, and in order to improve the heat exchange efficiency, a structure including fins provided on the partition wall, a structure including pores in the heat transfer surface of the partition wall, and the like to increase the heat transfer area are employed.

For example, the heat exchanger is known, which includes a heat transfer tube through which the coolant circulates, and fins contacting the heat transfer tube, in which each fin has a fin main body provided with fine grooves on a surface thereof (see JP2017-150756A).

In addition, the heat exchanger is known, which is made of aluminum or aluminum alloy, for example, and includes metal fins each having an anodized aluminum coating formed on a surface thereof (see JP2011-252192A).

A partition wall type heat exchanger often does not employ the heat transfer fins from the viewpoint of increased manufacturing cost and space, in which case heat is exchanged directly through the metallic partition wall. For this heat exchanger, it is also a challenge to improve the heat exchange efficiency of the partition wall. Further, even a heat exchanger having heat transfer fins is required to further improve the heat exchange efficiency of the heat exchanger as a whole.

Meanwhile, the major factor that determines the performance of a heat exchanger is the heat transfer coefficient (a reciprocal is the thermal resistance) between fluid and the partition wall surface that exchanges heat, and in particular, the heat transfer coefficient is much lower when the fluid is gas than when the fluid is a liquid, which limits the performance improvement of the heat exchanger as a whole. The heat transfer coefficient is determined by the Reynolds number (flow velocity, kinematic viscosity, and representative dimensions), Prandtl number, Nusselt number, or the like inherent to the fluid, but the partition wall surface roughness also has an effect especially in the case of the forced convection. In general, a larger surface roughness leads into an increased actual surface area in contact with the fluid, and the rising tendency of the heat transfer rate due to destruction of the boundary layer, but due to a complicated relationship including pressure loss, the related art relies the surface roughness on the differences in manufacturing methods such as machining and casting.

SUMMARY

The present disclosure provides a heat exchanger that improves a heat exchange efficiency of partition walls and a method for manufacturing the same.

According to an aspect of the present disclosure, there is provided a heat exchanger including a partition wall that separates two fluids having different temperatures, in which a plurality of grooves having a depth of 100 μm to 400 μm are formed in a thickness direction of the partition wall on a first wall surface of the partition wall which is a surface on a side in contact with a fluid of the two fluids that has a lower heat transfer coefficient.

According to another aspect of the present disclosure, there is provided a heat exchanger including a partition wall that separates a gas and a liquid and that exchanges heat between the gas and the liquid, in which a plurality of grooves having a depth of 100 μm to 400 μm are formed in a thickness direction of the partition wall on a first wall surface of the partition wall which is a surface on a side in contact with the gas.

According to still another aspect of the present disclosure, there is provided a method for manufacturing a heat exchanger, including: molding a partition wall that separates two fluids having different temperatures based on additive manufacturing; and when molding the partition wall based on the additive manufacturing, forming a plurality of grooves having a depth of 100 μm to 400 μm in a thickness direction of the partition wall on a first wall surface of the partition wall which is a surface on a side in contact with a fluid of the two fluids that has a lower heat transfer coefficient.

According to the present disclosure, the heat exchange efficiency can be improved by intentionally designing the surfaces of the partition walls.

DESCRIPTION OF EMBODIMENTS

Hereinafter, a heat exchanger and a method for manufacturing the same according to an embodiment of the present disclosure will be described with reference to the drawings.

Figure 1:
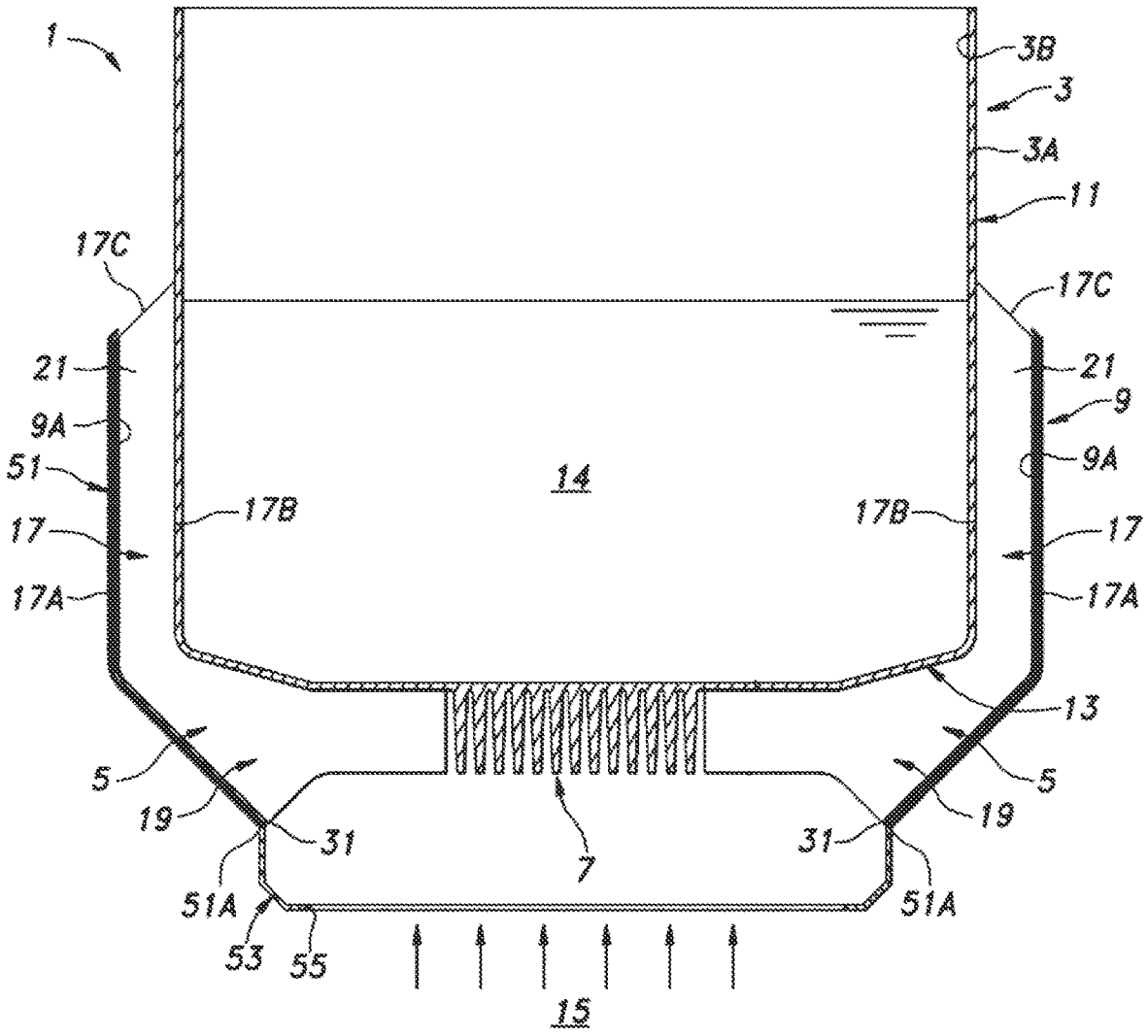
FIG. 1 is a cross-sectional view showing a schematic configuration of a heat exchanger according to an embodiment of the present disclosure.
Figure 2:
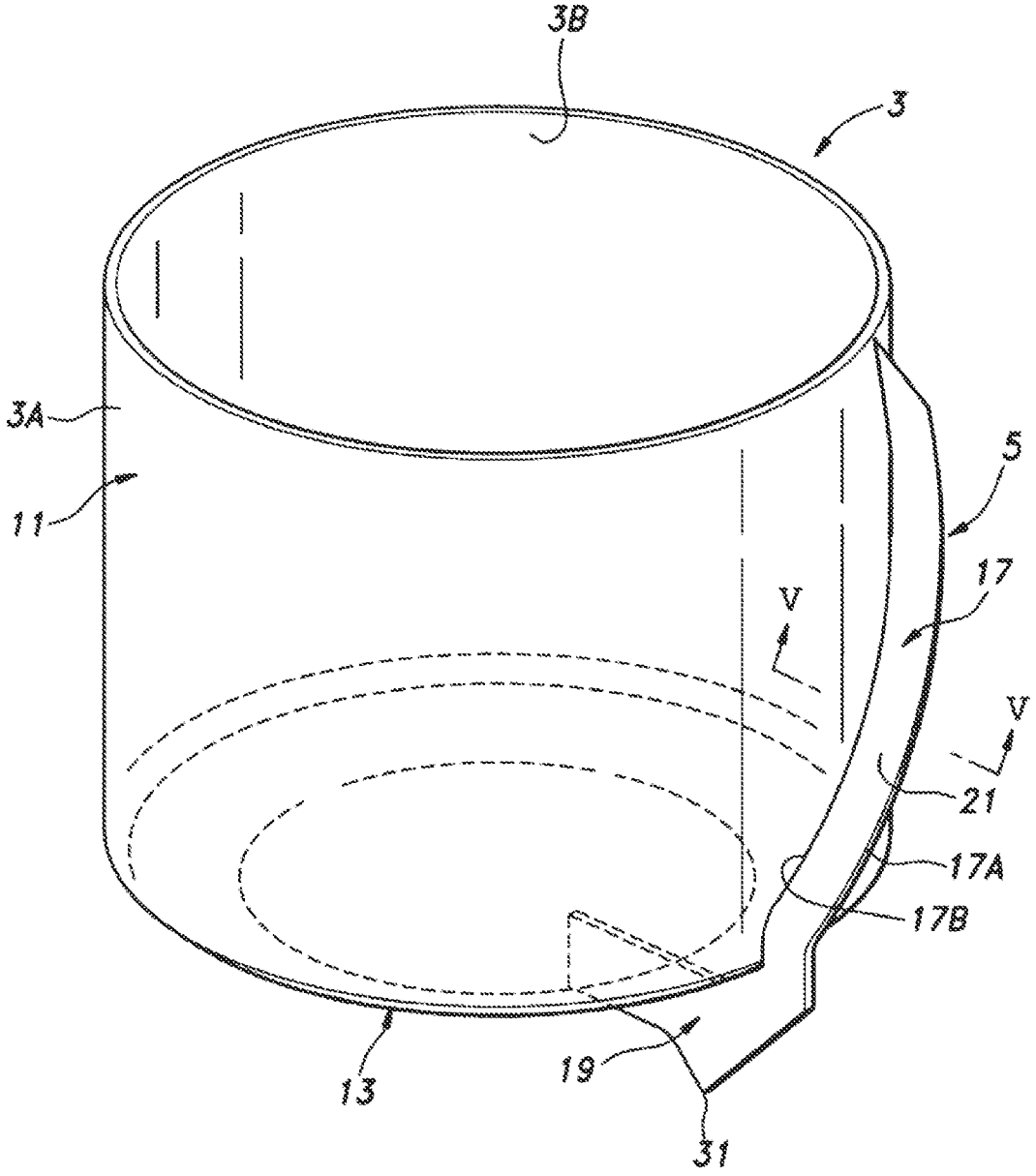
FIG. 2 is a perspective view showing one fin formed on a partition wall.

As shown in FIGS. 1 and 2, a heat exchanger 1 mainly includes a partition wall 3, a plurality of plate-shaped fins 5, a plurality of pin-shaped fins 7 (hereinafter, referred to as pin-shaped fins 7), and a shell 9. In the heat exchanger 1, two fluids (first and second fluids) of different temperatures, separated by the partition wall 3, indirectly contact each other so that heat is exchanged therebetween.

The partition wall 3 forms a body of the heat exchanger 1 as a bottomed tubular body. The partition wall 3 has a side circumferential portion 11 in a substantially cylindrical shape, and a bottom portion 13 configured to close an opening on one side (on a lower side in this example) of the side circumferential portion 11. A first fluid 14 which includes a liquid to be heated having a relatively low temperature (for example, water at a room temperature) is injected into the partition wall 3. In addition, a second fluid 15 which includes a gas at a higher temperature than the first fluid (in this example, a high temperature combustion gas from a combustor not shown) flows outside the partition wall 3.

Figure 3:
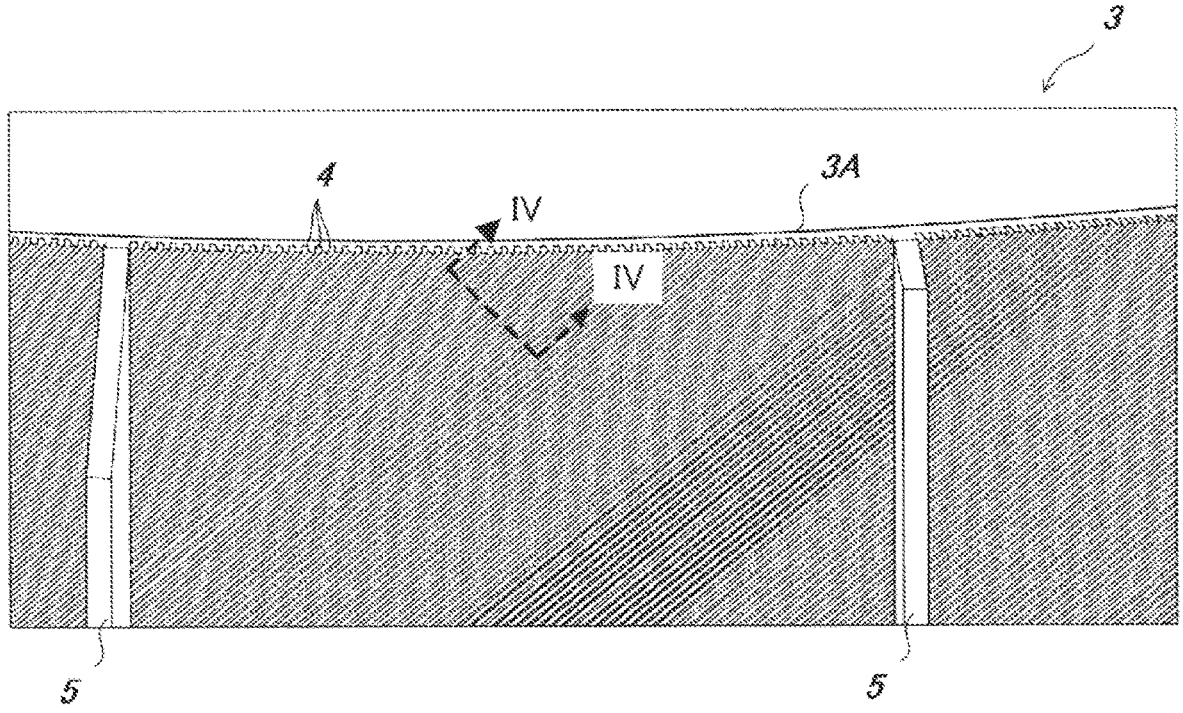
FIG. 3 is an enlarged perspective view showing a plurality of grooves formed on an outer surface of the partition wall.
Figure 4:
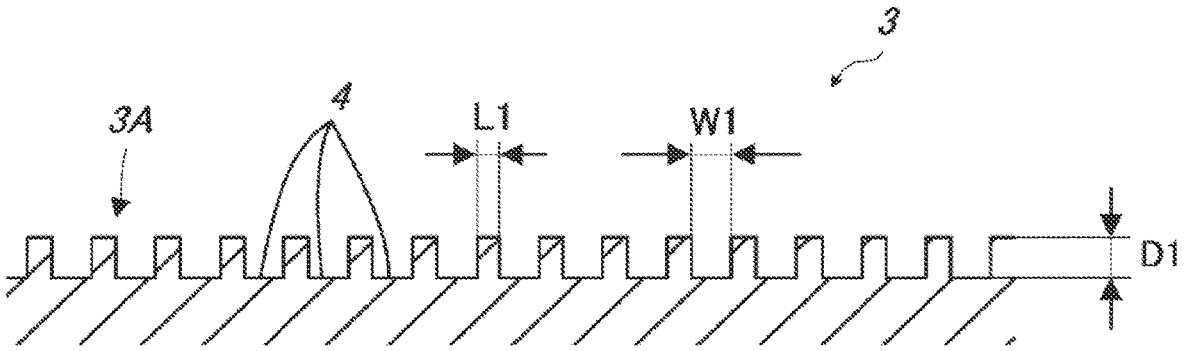
FIG. 4 is a cross-sectional view of the outer surface of the partition wall, which is a cross section taken along IV-IV in FIG. 3.

As shown in FIGS. 3 and 4, an outer surface 3A (first wall surface) of the partition wall 3 is formed with a plurality of grooves 4 arranged at predetermined intervals L1. The plurality of grooves 4 extend from the outer surface 3A of the side circumferential portion 11 obliquely upward (in this example, in a direction inclined upward to the right). Due to the presence of the plurality of grooves 4 obliquely extending upward, the second fluid 15 easily flows along the axial and circumferential directions of the side circumferential portion 11. Although not shown, the plurality of grooves 4 are also formed in the outer surface 3A of the bottom portion 13. It is to be noted that the plurality of grooves 4 are formed by design, not by surface roughness formed as the partition walls 3 are manufactured.

The depth D1 of the plurality of grooves 4 (the depth of the partition wall 3 in the thickness direction) may be set to 100 μm to 400 μm. Similarly, the width W1 of the plurality of grooves 4 may be set to about twice the depth D1 (200 μm to 800 μm). Also, the interval L1 between adjacent grooves 4 may be set to 100 μm to 300 μm.

By providing such a plurality of grooves 4 on the outer surface 3A of the partition wall 3 where the second fluid 15 flows, it is possible to improve the heat exchange efficiency of the partition wall 3. In particular, when the second fluid 15 is a gas, the heat transfer coefficient is much lower than that of a liquid, but by applying fine unevenness of 100 μm to 400 μm to the outer surface 3A of the partition wall 3, it is possible to increase the surface area, control the boundary layer flow and improve the heat exchange efficiency while maintaining the overall size. Moreover, since it is not necessary to attach a member for promoting heat efficiency to the heat exchanger 1 in order to improve the heat exchange efficiency, the heat exchanger 1 is prevented from becoming large sized. Furthermore, since the depth D1 of the grooves 4 is minute, it is possible to prevent the appearance of the partition walls 3 from being affected.

The amount of heat transferred between two fluids separated by the partition wall 3 can also be considered as a heat resistance. The thermal resistance is the reciprocal of heat transfer coefficient (thermal conductivity). When the thermal resistance due to heat transfer between the first fluid 14 and the partition wall 3 is R1, the thermal resistance due to heat conduction inside the partition wall 3 is R2, and the thermal resistance due to the heat transfer between the second fluid 15 and the partition wall 3 is R3, the combined thermal resistance is R1+R2+R3, the sum of the three thermal resistances, likewise the electrical resistances in an electrical circuit. This is called the law of similarity between heat and electricity. Since a large amount of thermal energy is to be exchanged between the first fluid 14 and the second fluid 15, it is effective to reduce the largest thermal resistance in order to reduce the combined thermal resistance. That is, it is effective to increase the heat transfer coefficient of the surface in contact with the fluid with low thermal conductivity. Conversely, when the heat transfer coefficient and thickness of the partition wall 3, which originally has a small thermal resistance, are changed, there is almost no effect on the total combined thermal resistance.

The partition wall 3 is an integrally molded article that is integrated with the fins 5 and the pin-shaped fins 7. The partition wall 3, the fins 5, and the pin-shaped fins 7 are made of a same metal material (here, aluminum).

The outer surface 3A of the partition wall 3 is formed with the plurality of fins 5. Further, as shown in FIG. 2, each fin 5 extends in a longitudinal direction from the side circumferential portion 11 to the bottom portion 13 of the partition wall 3. Each of the fins 5 includes a side portion (first portion) 17 having an inner edge connected to the outer surface of the side circumferential portion 11 and a base portion (second portion) 19 having an inner edge connected to the outer surface of the bottom portion 13.

Each fin 5 has a pair of heat transfer surfaces 21, 21 (main heat transfer surfaces) disposed to intersect or perpendicularly to the circumferential direction of the side circumferential portion 11.

As shown in FIG. 2, the side portion 17 of each fin 5 configures a helically curved part extending obliquely upward (namely, in the longitudinal direction) from an upper edge of the base portion 19 along the side circumferential portion 11 of the partition wall 3. In this way, by curving at least a part of each fin 5, it is possible to facilitate the flow of the fluid (to increase the flow velocity of the fluid) in the vicinity of the surfaces of the plurality of fins 5.

The width of the side portion 17 of each fin 5 (the distance between an outer edge 17A and an inner edge 17B) is substantially uniform substantially over the entirety of the side portion 17 in the longitudinal direction (see FIG. 1). Meanwhile, an upper edge 17C of the side portion 17 as seen from the side is formed at an acute angle relative to the outer surface 3A of the partition wall 3. Note that the side portion 17 is not particularly limited as long as at least a part of the side portion 17 forms the curved part (namely, the part formed with curved surfaces serving as the heat transfer surfaces). Further, the shape of the curved part is not limited to helical only, and any shape may be used as long as it has the curved surface.

Figure 5:
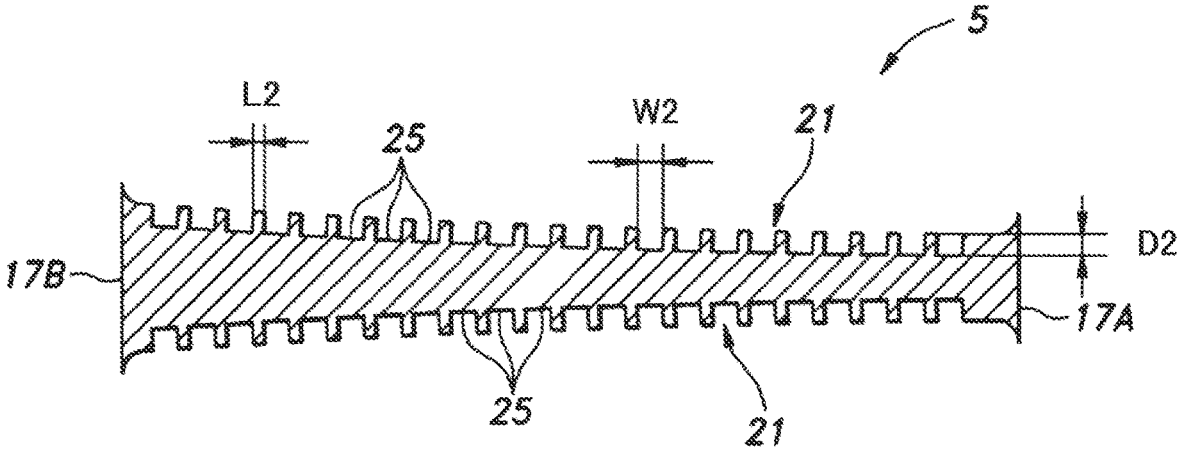
FIG. 5 is a cross-sectional view of a fin, which is a cross section taken along line V-V in FIG. 2.

As shown in FIG. 5, in a cross section perpendicular to the longitudinal direction (a cross section taken along a line V-V in FIG. 2), the side portion 17 of each fin 5 is formed to taper from the inner edge 17B toward the outer edge 17A. Thus, the space between the adjacent fins 5 (namely, the space between the adjacent heat transfer surfaces 21) increases gradually from the inner side (on the side of the partition wall 3) toward the outer side. As a result, stagnation of the fluid between the adjacent fins 5 can be prevented.

The pair of heat transfer surfaces 21, 21 in the side portion 17 are formed with a plurality of grooves 25 arranged at predetermined intervals from the inner edge 17B to the outer edge 17A. From the viewpoint of improving the heat exchange efficiency, the depth D2 of the plurality of grooves 25 (the depth in the thickness direction of each fin 5 substantially perpendicular to the heat transfer surfaces 21, 21) may preferably be set to 100 μm to 400 μm. Similarly, the width W2 of the plurality of grooves 25 may preferably be set to about twice the depth D2 (200 μm to 800 μm). Further, the interval L2 between the adjacent grooves 25 may preferably be set to 100 μm to 300 μm. Note that the grooves 25 are not particularly limited as long as the grooves 25 are formed on at least one of the pair of heat transfer surfaces 21.

The base portion 19 of each fin 5 has a substantially straight shape in the longitudinal direction (as seen from the bottom). The base portion 19 extends from a lower edge 17D of the side portion 17 (see FIG. 6) along the bottom portion 13 of the partition wall 3. The base portion 19 as seen from the side is provided with a projection 31 protruding downward into a substantially right angled tip. Although not shown in the drawings, similarly to the side portion 17, the base portion 19 is configured to taper from the inner edge toward the outer edge.

Figure 6:
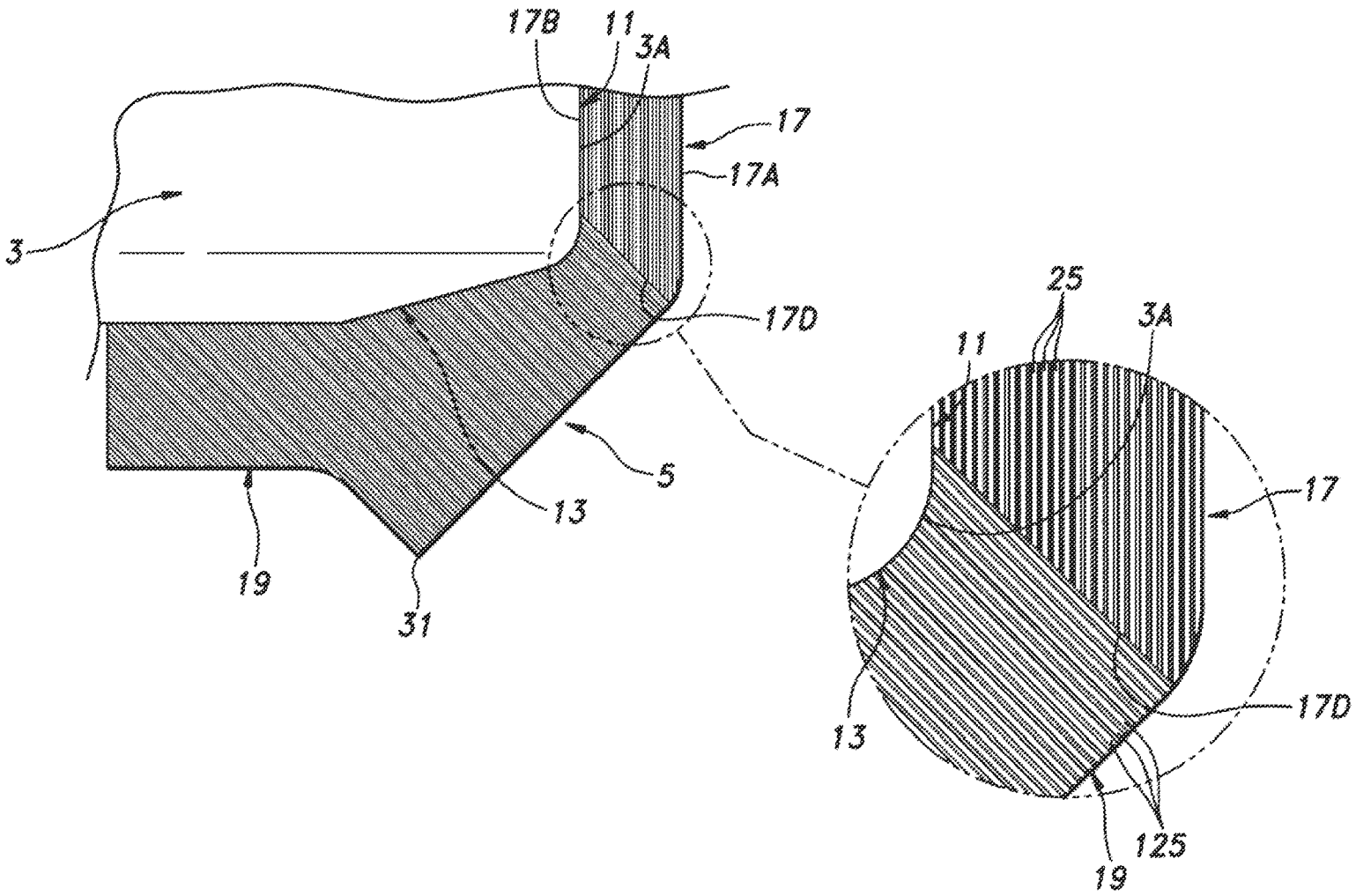
FIG. 6 is an explanatory view showing the detailed structure of a heat transfer surface of the fin.

Likewise the side portion 17, the pair of heat transfer surfaces 21, 21 of the base portion 19 are also formed with a plurality of grooves 125, but the extension direction of the grooves 125 is different from that of the grooves 25 of the side portion 17. Specifically, as shown in FIG. 6, the grooves 25 in the side portion 17 each extends in the longitudinal direction (in this example, in the substantially vertical direction) along a part of the outer surface 3A in the side circumferential portion 11 of the partition wall 3 (namely, along the side circumferential surface). Meanwhile, the grooves 125 in the base portion 19 each extends toward a part of the outer surface 3A (bottom surface) in the bottom portion 13 of the partition wall 3 (in this example, in a direction inclined to the left, facing upward). The depth, width, and interval of the grooves 125 may be set similarly to those of the grooves 25 in the side portion 17.

As described above, it is possible to guide the second fluid in the vicinity of the bottom surface of the bottomed tubular body to flow toward the bottom surface by means of the plurality of grooves 125, thereby promoting heat transfer at the bottom portion 13 of the bottomed tubular body, and also guide the second fluid in the vicinity of the side circumferential surface of the bottomed tubular body to flow along the side peripheral surface by means of the plurality of grooves 25, thereby promoting the heat transfer at the side circumferential portion 11 of the bottomed tubular body.

Further, in the present embodiment, the partition wall 3 forms a bottomed tubular body and thus each fin 5 has the base portion 19, but it is to be noted that the base portion 19 may be omitted when the partition wall 3 forms another structure (for example, a tubular body).

Figure 7:
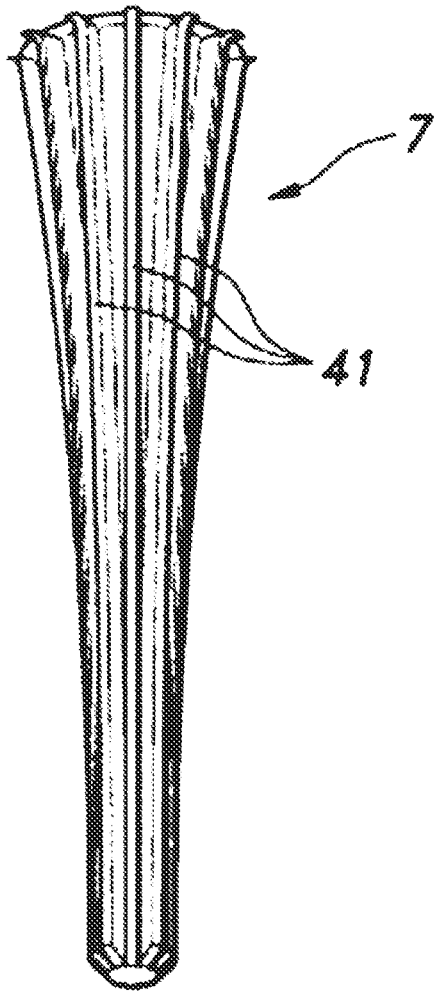
FIG. 7 is a perspective view of a pin-shaped fin.

In the bottom portion 13 of the partition wall 3, the inner edges of the base portions 19 of the plurality of fins 5 define a substantially circular region in which the plurality of pin-shaped fins 7 are arranged. As shown in FIG. 7, each pin-shaped fin 7 has a tapering cylindrical columnar (or conical) shape. The circumferential surface of each pin-shaped fin 7 is formed with a plurality of ridges 41 extending in the longitudinal direction (protruding direction). The plurality of ridges 41 are disposed at predetermined intervals in the circumferential direction.

Due to the presence of the plurality of ridges 41, the surface area of each pin-shaped fin 7 is increased. Further, since the plurality of ridges 41 are formed on each pin-shaped fin 7 having a tapering shape, an effect of reducing the thickness of a temperature boundary layer formed in the vicinity of the surface of the pin-shaped fin 7 can be obtained. As a result, the thermal resistance to the first fluid 14 inside the partition wall 3 is decreased and convection heat transfer of the first fluid is promoted.

An inner surface 3B (a second wall surface) of the partition wall 3 is formed with a non-sealed anodized aluminum coating. The anodized aluminum coating is formed with a plurality of pores each having a pore diameter of 10 nm to 30 nm. Like the outer surface 3A of the partition wall 3, the inner surface 3B of the partition wall 3 may be provided with fine unevenness of 100 μm to 400 μm, but when the first fluid is a liquid, the effect on the amount of heat transfer is small. When the first fluid is a liquid, foreign matter contained in the liquid may get caught in the fine unevenness, which may rather cause an unfavorable situation from a sanitary point of view. Therefore, the inner surface 3B (second wall surface) of the partition wall 3 is formed with an anodized aluminum coating in which a plurality of pores each having a pore diameter of 10 nm to 30 nm are formed. As a result, in the heat exchanger 1, the fins 5 formed on the outer surface 3A of the partition wall 3 promote heat transfer between the second fluid and the partition wall 3, while the pores formed on the inner surface 3B of the partition wall 3 promote heat transfer between the first fluid and the partition wall 3. Meanwhile, the anodized aluminum coating may be omitted. Also, the anodized aluminum coating may be formed only on a part of the inner surface 3B of the partition wall 3.

The shell 9 is substantially tubular in shape and is configured to cover the outer sides of the plurality of fins 5, as shown in FIG. 1. As a result, an inner surface 9A of the shell 9 and the outer surface 3A of the partition wall 3 define a flow path for the second fluid 15, and the plurality of fins 5 are positioned in the flow path.

The shell 9 has an upper portion 51 connected to the outer edges of the plurality of fins 5 positioned opposite from the partition wall 3, and a lower portion 53 connected to the lower edge of the upper portion 51 and extending downward. A lower edge 51A of the upper portion 51 is connected to the corner of the projection 31 of the base portion 19 of each fin 5. The lower portion 53 has an opening 55 positioned outside (in this example, on the lower side of) the pin-shaped fins 7 and substantially circular in shape. The opening 55 forms an inlet for the second fluid 15. With this shell 9, it is possible to efficiently guide the second fluid to the fins 5 provided on the bottomed tubular body.

In the manufacture of the heat exchanger 1 with the structure described above, the partition wall 3, the plurality of fins 5, and the plurality of pin-shaped fins 7 are integrally molded using a known 3D printing technology (additive manufacturing). The processing method used in the additive manufacturing is not particularly limited as long as the structure described above can be achieved. For example, the heat exchanger 1 is molded by simultaneously jetting the metal powder and irradiating laser (or electron beam) onto a target part to form layers of molten metal powder in the shape described above.

The shell 9 may be integrally molded with the partition wall 3 or the like. Alternatively, the shell 9 may be formed of a metal material different from the metal material forming the partition wall 3 and then attached by welding or the like so as to cover the outer sides of the plurality of fins 5.

The non-sealed anodized aluminum coating on the inner surface 3B of the partition wall 3 is formed by a known anodizing process (aluminum anodization process). The structure (pore diameter or the like) of the plurality of pores of the anodized aluminum coating may be checked using a field emission scanning electron microscope (FE-SEM), for example.

When using the heat exchanger 1, for example, a user pours water into the partition wall 3 as the first fluid and then starts a combustor (for example, a gas burner) disposed below the heat exchanger 1. Accordingly, the combustion gas of the combustor serving as the second fluid is introduced through the opening 55 of the shell 9. The combustion gas flows among the plurality of fins 5 positioned between the partition wall 3 and the shell 9 and is discharged from an open upper portion of the shell 9. At this time, the heat of the combustion gas is transferred to the partition wall 3, the fins 5, and the pin-shaped fins 7 and further transferred to the first fluid via the inner surface 3B of the partition wall 3. Due to this heat exchange between the combustion gas and the water, it is possible to increase the temperature of the water inside the partition wall 3 (eventually, to boil the water).

As described above, in the heat exchanger 1, the partition wall 3 and the plurality of fins 5 are integrally molded so as to reduce the thermal resistance at the interface between each fin 5 and the partition wall 3, and the grooves of appropriate depths are formed on the plurality of fins 5 each having a curved part (in this example, the side portion 17) so as to increase the heat transfer area of the fins 5 while facilitating the flow of the second fluid in the vicinity of the surfaces of the fins 5. As a result, it is possible to improve the heat exchange efficiency of the heat exchanger 1.

Although the embodiment of the present disclosure has been described above with reference to the accompanying drawings, it goes without saying that the present disclosure is not limited to such an embodiment. It will be apparent that those skilled in the art, within the scope described in the claims, can come up with various kinds of modification examples, or modifications, which are naturally within the technical scope of the present disclosure. In addition, the components in the embodiment described above may be arbitrarily combined without departing from the spirit of the disclosure.

The heat exchanger 1 may include the partition wall 3 in which a plurality of grooves 4 are formed, and may not include the fins 5 or the shell 9. Moreover, when the heat exchanger 1 includes the fins 5 and the shell 9, a sufficient number of fins 5 (for example, three) may be provided to support the shell 9.

The plurality of grooves 4 of the partition wall 3 may not be formed over the entire outer surface 3A. For example, the grooves 4 may be formed only on the outer surface 3A of the side circumferential portion 11 or only on the outer surface 3A of the bottom portion 13. Moreover, the plurality of grooves 4 may be partially formed on the outer surface 3A of the side circumferential portion 11 or partially formed on the outer surface 3A of the bottom portion 13.

The partition wall 3 of the heat exchanger 1 is not limited to the bottomed tubular body, and various shapes used in the known heat exchangers may be adopted. For example, the partition wall 3 may form a tubular body that separates the first fluid and the second fluid. In that case, the first fluid flows in a predetermined direction inside the partition wall 3.

Also, the first fluid and the second fluid are not necessarily the combination of liquid and gas, and any combination of fluids (for example, a combination of liquids or a combination of gases) may be adopted. The heat exchanger 1 may use at least two fluids and may also use three or more fluids to conduct heat exchange therebetween.

The heat exchanger 1 may be used in a refrigerator, an industrial heat exchanger, a plate-shaped heat exchanger, pipe-shaped passage-type heat exchanger, for example. Further, the heat exchanger 1 may be used as a part of a device or a machine that has a partition wall and thereby can function as a heat exchanger. The heat exchanger 1 may be used, for example, in a fluid passage structure of an air-cooled engine head, a radiator, an oil cooler, a water boiler, an air-conditioning facility, an exhaust gas recirculation (EGR) cooler, a stirling engine, or the like.

At least the following characteristics have been described herein. While the corresponding components and the like in the embodiments described above are indicated in parenthesis, embodiments are not limited thereto.

(1) A heat exchanger (the heat exchanger 1) including a partition wall (the partition wall 3) that separates two fluids having different temperatures, in which a plurality of grooves (the grooves 4) having a depth of 100 μm to 400 μm are formed in a thickness direction of the partition wall on a first wall surface (the outer surface 3A) of the partition wall, in which the first wall surface is a surface on a side in contact with a fluid of the two fluids that has a lower heat transfer coefficient.

According to (1), a plurality of grooves having a depth of 100 μm to 400 μm are formed in a thickness direction of the partition wall on a first wall surface of the partition wall, in which the first wall surface is one of the wall surfaces of the partition wall separating the two fluids, that is on a side in contact with a fluid having a lower heat transfer coefficient. Therefore, it is possible to increase the surface area of the partition wall. As a result, it is possible to improve the heat exchange efficiency of the heat exchanger.

(2) The heat exchanger according to (1), in which, in the partition wall, a plurality of pores each having a pore diameter of 10 nm to 30 nm are formed on a second wall surface (the inner surface 3B) of the partition wall, in which the second wall surface is a surface on a side in contact with a fluid of the two fluids that has a higher heat transfer coefficient.

According to (2), the plurality of grooves formed on the first wall surface of the partition wall can promote heat transfer between one of the two fluids (for example, gas) and the partition wall, and also the pores formed on the second wall surface of the partition wall can promote heat transfer between the other of the two fluids (for example, liquid) and the partition wall.

(3) The heat exchanger according to (1) or (2), further including a plurality of plate-shaped fins (fins 5) formed on the first wall surface of the partition wall and having a pair of heat transfer surfaces (the heat transfer surfaces 21), in which the partition wall and the plurality of fins are integrally molded products made of a same metal material, the plurality of fins have a curved part and are arranged so as to be spaced from each other in a direction intersecting the pair of heat transfer surfaces, and a plurality of grooves (the grooves 25) having a depth of 100 μm to 400 μm are formed in the pair of heat transfer surfaces in a thickness direction of each fin.

According to (3), since the partition wall and the plurality of fins are integrally molded, the thermal resistance at the interface between each fin and the partition wall can be reduced. Further, by forming the grooves having the depth of 100 μm to 400 μm on the plurality of fins having a curved part, it is possible to increase the heat transfer area of the fins while facilitating the flow of the fluid in the vicinity of the surfaces of the fins. As a result, it is possible to improve the heat exchange efficiency of the heat exchanger.

(4) The heat exchanger according to (3), in which the partition wall forms a bottomed tubular body, the plurality of fins are each connected to a bottom surface (the bottom portion 13) and a side circumferential surface (the side circumferential portion 11) of the bottomed tubular body which form an outer surface of the bottomed tubular body, in a first portion (the side portion 17) of each fin connected to the bottom surface of the bottomed tubular body, the plurality of grooves extend toward the bottom surface respectively, and in a second portion (the base portion 19) of each fin connected to the side circumferential surface of the bottomed tubular body, the plurality of grooves extend along the side circumferential surface respectively.

According to (4), the fluid in the vicinity of the bottom surface of the bottomed tubular body is guided by the plurality of grooves to flow toward the bottom surface, whereby heat transfer at the bottom portion of the bottomed tubular body can be promoted. Also, the fluid in the vicinity of the side circumferential surface of the bottomed tubular body is guided by the plurality of grooves to flow along the side circumferential surface, whereby heat transfer at the side circumferential portion of the bottomed tubular body can be promoted.

(5) The heat exchanger according to (4), further including a shell (the shell 9) which is provided to cover outer sides of the plurality of fins and to which outer edge portions (the outer edge 17A) of the plurality of fins opposite to the partition wall are connected respectively.

According to (5), the shell covering the outer sides of the plurality of fins can efficiently guide the fluid to the fins provided on the bottomed tubular body.

(6) The heat exchanger according to (4) or (5), further including a plurality of pin-shaped fins (the pin-shaped fins 7) protruding outward respectively in a region of the bottom surface of the bottomed tubular body where the plurality of fins are not formed.

According to (6), the pin-shaped fins can effectively promote heat transfer at the bottom portion of the bottomed tubular body.

(7) The heat exchanger according to any one of (4) to (6), in which the curved part of each of the plurality of fins is curved helically.

According to (7), it is possible to facilitate the flow of the fluid (to increase the flow velocity of the fluid) in the vicinity of the surfaces of the plurality of fins.

(8) The heat exchanger according to any one of (3) to (7), in which each fin has a cross section tapering in a direction away from the partition wall.

According to (8), it is possible to prevent stagnation of fluid between adjacent fins.

(9) A heat exchanger including a partition wall that separates a gas and a liquid and that exchanges heat between the gas and the liquid, in which a plurality of grooves having a depth of 100 μm to 400 μm are formed in a thickness direction of the partition wall on a first wall surface of the partition wall which is a surface on a side in contact with the gas.

According to (9), the plurality of grooves having the depth of 100 μm to 400 μm are formed in the thickness direction of the partition wall on the first wall surface of the partition wall. Therefore, it is possible to increase the surface area of the partition wall. As a result, it is possible to improve the heat exchange efficiency of the heat exchanger.

(10) The heat exchanger according to (9), in which, in the partition wall, a plurality of pores each having a pore diameter of 10 nm to 30 nm are formed on a second wall surface of the partition wall which is a surface on a side in contact with the liquid.

According to (10), the plurality of grooves formed on the first wall surface of the partition wall can promote heat transfer between the gas and the partition wall, and the pores formed on the second wall surface of the partition wall can promote heat transfer between the liquid and the partition wall.

(11) A method for manufacturing a heat exchanger (the heat exchanger 1) including: molding a partition wall (the partition wall 3) that separates two fluids having different temperatures based on additive manufacturing- and when molding the partition wall based on the additive manufacturing, forming a plurality of grooves (the grooves 4) with a depth of 100 μm to 400 μm in a thickness direction of the partition wall on a first wall surface (the outer surface 3A) of the partition wall provided on a side of high temperature fluid of the two fluids.

According to (11), when molding the partition wall of the heat exchanger based on the additive manufacturing, a plurality of grooves with a depth of 100 μm to 400 μm are formed in the thickness direction of the partition wall on the first wall surface of the partition wall provided on the side of the high temperature fluid. Therefore, it is possible to increase the surface area of the partition wall. As a result, it is possible to improve the heat exchange efficiency of the heat exchanger.

The invention claimed is:

1. A heat exchanger comprising a partition wall that separates two fluids having different temperatures, wherein a plurality of grooves having a depth of 100 μm to 400 μm are formed in a thickness direction of the partition wall on a first wall surface of the partition wall which is a surface on a side in contact with a fluid of the two fluids that has a lower heat transfer coefficient, and in the partition wall, a plurality of pores each having a pore diameter of 10 nm to 30 nm are formed on a second wall surface of the partition wall which is a surface on a side in contact with a fluid of the two fluids that has a higher heat transfer coefficient.

2. The heat exchanger according to claim 1, further comprising a plurality of plate-shaped fins formed on the first wall surface of the partition wall and having a pair of heat transfer surfaces, wherein:

the partition wall and the plurality of fins are integrally molded products made of a same metal material;

the plurality of fins have a curved part and are arranged so as to be spaced from each other in a direction intersecting the pair of heat transfer surfaces; and a plurality of grooves having a depth of 100 um to 400 um are formed in the pair of heat transfer surfaces in a thickness direction of each fin.

3. The heat exchanger according to claim 2, wherein:

the partition wall forms a bottomed tubular body;

the plurality of fins are each connected to a bottom surface and a side circumferential surface of the bottomed tubular body which form an outer surface of the bottomed tubular body;

in a first portion of each fin connected to the bottom surface of the bottomed tubular body, the plurality of grooves extend toward the bottom surface respectively; and in a second portion of each fin connected to the side circumferential surface of the bottomed tubular body, the plurality of grooves extend along the side circumferential surface respectively.

4. The heat exchanger according to claim 3, further comprising a shell which is provided to cover outer sides of the plurality of fins and to which outer edge portions of the plurality of fins opposite to the partition wall are connected respectively.

5. The heat exchanger according to claim 3, further comprising a plurality of pin-shaped fins protruding outward respectively in a region of the bottom surface of the bottomed tubular body where the plurality of fins are not formed.

6. The heat exchanger according to claim 2, wherein the curved part of each of the plurality of fins is curved helically.

7. The heat exchanger according to claim 2, wherein each fin has a cross section tapering in a direction away from the partition wall.

8. A heat exchanger comprising a partition wall that separates a gas and a liquid and that exchanges heat between the gas and the liquid, wherein a plurality of grooves having a depth of 100 μm to 400 μm are formed in a thickness direction of the partition wall on a first wall surface of the partition wall which is a surface on a side in contact with the gas, and in the partition wall, a plurality of pores each having a pore diameter of 10 nm to 30 nm are formed on a second wall surface of the partition wall which is a surface on a side in contact with the liquid.

9. A method for manufacturing a heat exchanger, comprising:

molding a partition wall that separates two fluids having different temperatures based on additive manufacturing; and when molding the partition wall based on the additive manufacturing, forming a plurality of grooves having a depth of 100 μm to 400 μm in a thickness direction of the partition wall on a first wall surface of the partition wall which is a surface on a side in contact with a fluid of the two fluids that has a lower heat transfer coefficient, wherein in the partition wall, a plurality of pores each having a pore diameter of 10nm to 30 nm are formed on a second wall surface of the partition wall which is a surface on a side in contact with a fluid of the two fluids that has a higher heat transfer coefficient.

* * * * *